US005095295A

United States Patent [19]

Hongou

[11] Patent Number: 5,095,295

[45] Date of Patent: Mar. 10, 1992

[54] SUPERCONDUCTING SWITCHING DEVICE

[75] Inventor: Masashi Hongou, Atsugi, Japan

[73] Assignee: Semiconductor Energy Laboratory Co., Ltd., Kanagawa, Japan

[21] Appl. No.: 403,341

[22] Filed: Sep. 6, 1989

[30] Foreign Application Priority Data

Sep. 8, 1988 [JP] Japan ..... 63-225072

[51] Int. Cl.[5] ..... H01H 1/66; H01H 51/00; H01H 9/00; H01F 1/00

[52] U.S. Cl. ..... 335/151; 335/216; 335/208; 335/146; 335/153

[58] Field of Search ..... 335/151, 153, 154, 216, 335/146, 208; 505/882

[56] References Cited

FOREIGN PATENT DOCUMENTS 0281330 11/1988 Japan ..... 335/151
0073677 3/1990 Japan ..... 335/216

*Primary Examiner*—Leo P. Picard
*Assistant Examiner*—Ramon M. Barrera
*Attorney, Agent, or Firm*—Sixbey, Friedman, Leedom & Ferguson

[57] ABSTRACT

A new type of reed switch is described. The switch is comprised of a fixed lead and a flexible reed made of a magnetic substance which are contacting in a glass enclosure. Two magnet rods are coaxially arranged in the same direction with a superconducting film therebetween. When the surrounding temperature is descended below Tc of the superconducting film, a dipole moment is formed across the superconducting film and moves the reed away from the lead by the magnetic force thereof.

9 Claims, 2 Drawing Sheets

SUPERCONDUCTING SWITCHING DEVICE

BACKGROUND OF THE INVENTION

The present invention relates to superconducting switching devices.

Reed switchs operatable in association with coils have been broadly used. Among them are thermal reed switchs which utilize the magnetic property of ferrites sensitive to the temperature change. The operation of the thermal switchs of this type, however, is associated with transition between ferrimagnetism and paramagnetism, and therefore the operational temperatures are as high as 250° K. or higher. Furthermore, the switching temperatures can be selected only from discrete points in correspondence with the transition temperatures of available ferrites or other ferrimagnetic materials.

SUMMARY OF THE INVENTION

It is therefore an object of the present invention to provide superconduting thermal reed switchs.

In order to accomplish the above and other objects and advantages, the reed switch consisting of a fixed lead and a flexible reed is provided with a pair of magnets which are arranged in a line in the same pole direction with a superconducting film interposed therebetween. The magnet-superconductor-magnet structure is used to produce, when superconducting-nonsuperconducting transition takes place, magnetic force by which the reed can move away from or into contact with the fixed lead.

BRIEF DESCRIPTION OF THE DRAWING

This invention can be better understood from the following detailed description when read in conjunction with the drawing in which.

DETAILED DESCRIPTION OF THE PREFERRED EMBODIMENTS

Figure 1:
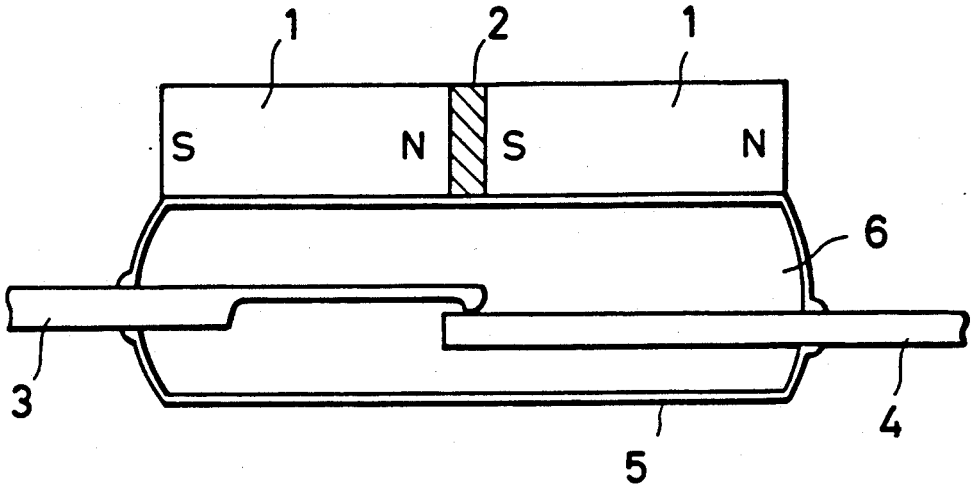
FIG. 1 is a cross sectional view showing a read switch in accordance with a first embodiment of the present invention.

Referring to FIG. 1, a reed switch in accordance with a first embodiment of the present invention is illustrated. The switch comprises a hermetic structure 5 made of glass or any other suitable material for confining helium gas and defining an inner space 6 therein, a fixed lead 4 terminating in its end at the center of the inner space 6, a flexible reed 3 terminating in its end which is contacting the end of the lead 4, a pair of permanent magnets 1 coaxially arranged on the structure 5 in the same direction, and a superconducting thin film 2 intervening the pair of magnets. The reed 3 is formed so thin as to be bent by magnetic force and made of a ferro-magnetic material such as an alloy of Ni(52%) and Fe(48%). The lead 4 is formed sufficiently thick as not to be deformed by magnetic force made of a diamagnetic material such as Cu or Bi. The superconducting film 2 is made of a ceramic oxide material which, for example, is prepared as described below.

Figure 2A:
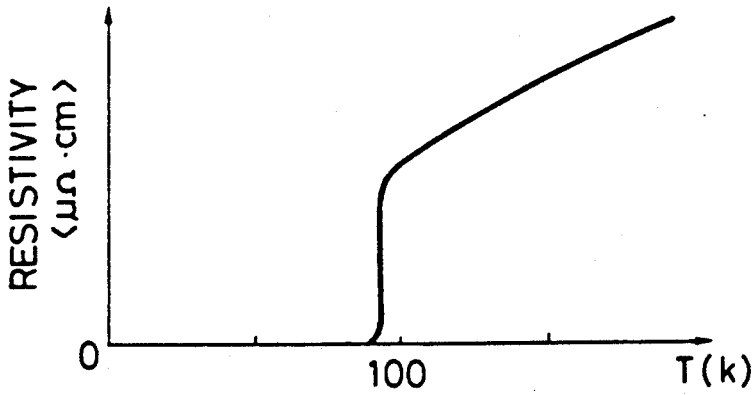
FIGS. 2(A) and 2(B) graphical diagram showing the resistivities of superconducting ceramics versus the temperature in accordance with the present invention.
Figure 2B:
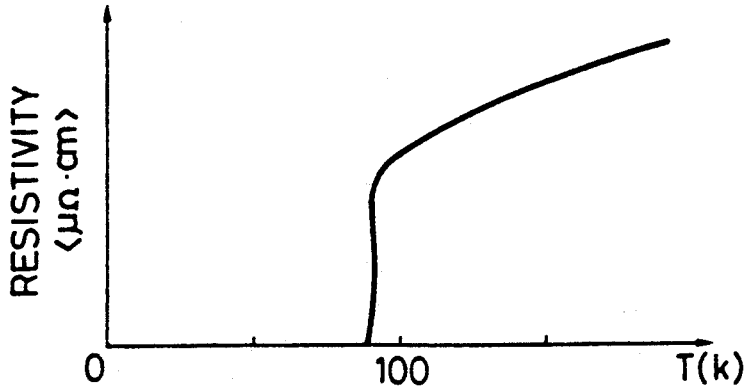

Prescribed amounts of powders of $Y_2O_3$, $BaCO_3$, and CuO of 99.9% or higher purity respectively were sufficiently mixed in the ratio of 1:2:3 conforming to a target composition of $YBa_2Cu_3O_{7-x}$, fired at 900° C. for 12 hours and compacted into a desired shape such as a plate. The compacted material was fired again at 900° C. for 3 hours, followed by gradually cooling. The oxygen proportion (7-x) can be controlled to increase by decreasing the speed of gradually cooling. The critical temperature of the ceramic material is higher at a higher oxygen proportion. Two sample superconducting films, named Sample A and Sample B, were prepared by changing the gradually cooling rate. Sample A was prepared employing a cooling rate of 2° K./min while Sample B was prepared employing a cooling rate of 7° K./min. The temperature-Tc relationships of Samples A and B are depicted in FIGS. 2(A) and 2(B) respectively. The Tc's of Samples A and B were measured to be 93° K. and 87° K.

The arrangement of the reed 3 and the lead 4 are designed so that they are electrically connected at the contact when the film 2 is non-superconducting. When the film 2 becomes superconducting, there is formed in the film 2 a dipole moment having the same magnitude as the dipole moment consisting of the opposite poles of the magnets 1 opposing to each other with the film 2 inbetween but having the opposite direction thereto due to the perfect diamagnetism of the superconducting film. The magnetic field experienced by the reed 3 is increased by the magnetic dipole moment formed by the daimagnetism and therefore bent away from the other lead 4. In a reed switch which was constructed with Sample A, the switch was turned off when the temperature fell down below 92° K. and turned on when the temperature elevated beyond 94° K. In a reed switch which was constructed with Sample B, the switch was turned off when the temperature fell down below 87° K. and turned on when the temperature elevated beyond 90° K.

Figure 3:
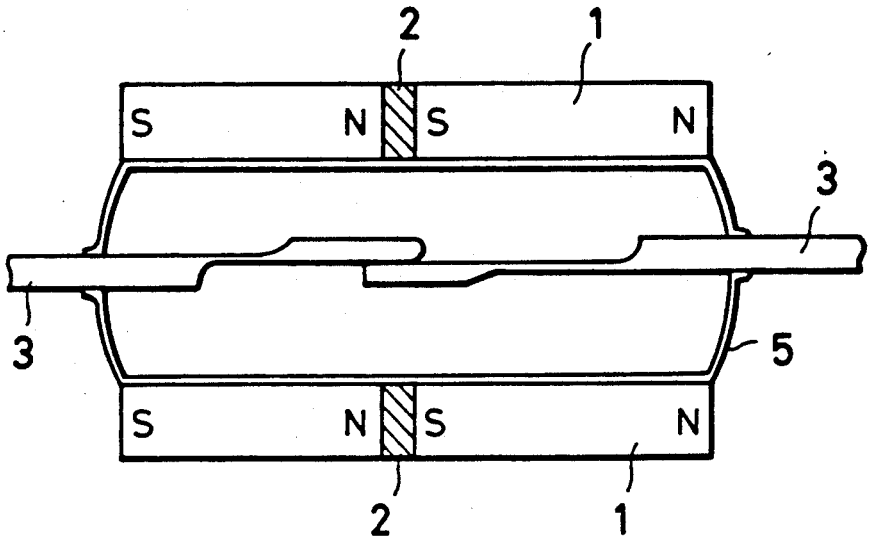
FIG. 3 is a cross sectional view showing a reed switch in accordance with a second embodiment of the present invention.

FIG. 3 shows a second embodiment in accordance with the present invention. This embodiment comprises a pair of reeds 3 both of which are constructed in the same manner as the reed 3 of the first embodiment shown in FIG. 1. Each reed 3 is provided with its own magnet-superconductor-magnet structure as illustrated in FIG. 1 and designated by numerals 1 and 2 respectively. The operation of each reed of this embodiment is same as that of the first embodiment.

Figure 4:
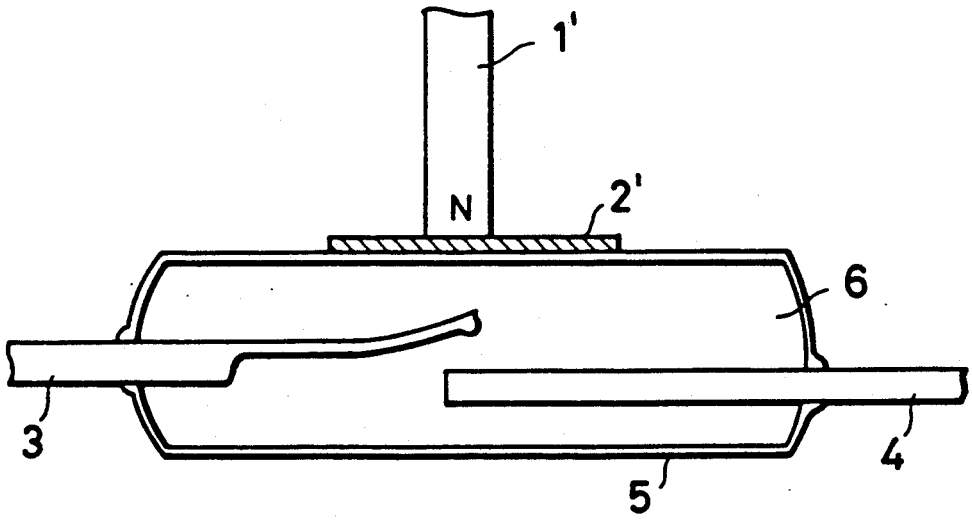
FIG. 4 is a cross sectional view showing a reed switch in accordance with a third embodiment of the present invention.

FIG. 4 shows a third embodiment of the present invention. This embodiment employs either pole of a magnet 1' just located beside the reed structure and a superconducting ceramic film 2' interposed between the reed structure and the magnet 1' in place of the magnet-superconductor-magnet structure as illustrated in FIG. 1. When the film 2' is superconducting, the reed 3 is shielded from the magnetic force of the magnet 1' and contacts the fixed lead 4. When the film 2' becomes non-superconducting, the reed 3 is attracted by the magnet 1' and moves away from the fixed lead 4.

While several embodiments have been specifically described by way of examples, it is to be appreciated that the present invention is not limited to the particular examples described and that modifications and variations can be made without departing from the scope of the invention as defined by the appended claims. For example, the superconducting films can be made from superconducting metals, alloys, or other oxide ceramic superconducting materials.

What is claimed is:

1. A superconducting reed switch comprising:

a hollow structure defining a switching space therein;

a contact electrode provided in said switching space;

a first flexible reed made of a magnetic substance adapted selectively to make contact with said contact electrode and to move away from said contact electrode;

a first magnet located near said reed; and a superconducting member located in order that, due to the magnetic force induced by said member, the reed moves between a first position to make contact with said contact electrode and a second position to be apart from said contact electrode depending upon whether the surrounding temperature is lower than Tc of said superconducting member at which it exhibits perfect diamagnetism or not.

2. The switch of claim 1 wherein said contact electrode is the distal end of a fixed lead terminating in said switching space.

3. The switch of claim 2 further comprising a second magnet which is arranged coaxially with said first magnet in the same direction, wherein said first and second magnets are separated by said superconducting member.

4. The switch of claim 1 wherein said superconducting member is made of an oxide ceramic superconducting material.

5. The switch of claim 3 wherein said superconducting member is a superconducting film located just adjacent to the position in which said contact electrode and said reed are contacting.

6. The switch of claim 1 wherein said contact electrode is the end portion of a second reed which is provided in said switching space in the same manner as said first reed.

7. The switch of claim 6 wherein said second reed is provided with another magnet and another superconducting member which are located closer thereto than said first reed.

8. The switch of claim 1 wherein said magnet is arranged in order to direct its pole to said reed and said superconducting member is disposed between said reed and said pole.

9. A switching device comprising:

(a) means for inducing a magnetic field;

(b) a contact formed by first and second electrodes located in said magnetic field wherein at least one of said electrodes is made of a ferromagnetic material and movable in accordance with said magnetic field in order that said contact can assume open or closed states; and (c) a superconducting material so located as to change the magnetic field applied to said contact in response to whether the temperature of said superconducting material is lower than the Tc of said superconducting material or not.

* * * * *